US008353093B2

(12) United States Patent
Stewart et al.

(10) Patent No.: US 8,353,093 B2
(45) Date of Patent: Jan. 15, 2013

(54) ENGINE HOOD EXHAUST STACK MOUNTING METHOD

(76) Inventors: Joshua Lee Stewart, Madison, OH (US); Jeffrey A. Jasik, Fairport Harbor, OH (US)

( * ) Notice: Subject to any disclaimer, the term of this patent is extended or adjusted under 35 U.S.C. 154(b) by 268 days.

(21) Appl. No.: 12/807,492

(22) Filed: Sep. 7, 2010

(65) Prior Publication Data

US 2012/0055007 A1 Mar. 8, 2012

(51) Int. Cl.
*B60K 13/04* (2006.01)

(52) U.S. Cl. ..... 29/451; 29/525.01; 29/525.11; 29/525.12; 29/888.01; 29/897.2; 180/309

(58) Field of Classification Search ..... 29/451, 29/525.01, 525.02, 525.11, 888.01, 897.2; 180/309

See application file for complete search history.

(56) References Cited

U.S. PATENT DOCUMENTS 3,063,741 A * 11/1962 Bockerman ..... 285/283
3,345,092 A * 10/1967 Athman et al. ..... 285/283
3,352,573 A * 11/1967 Canning ..... 285/2
3,815,941 A * 6/1974 Snyder ..... 285/283
4,133,547 A * 1/1979 Fox ..... 180/68.3
4,471,853 A * 9/1984 Callaghan et al. ..... 180/309
4,506,749 A * 3/1985 Sieren ..... 180/69.2
5,328,209 A * 7/1994 Cromwell ..... 285/1
6,095,460 A 8/2000 Mercer
2009/0178880 A1* 7/2009 Uemura et al. ..... 181/229
2009/0229685 A1* 9/2009 Hageman et al. ..... 137/544

* cited by examiner

*Primary Examiner* — Derris Banks
*Assistant Examiner* — Anthony Green
(74) *Attorney, Agent, or Firm* — Robert Nathans

(57) ABSTRACT

For turbo-diesel application trucks, it is desirable to enable the quickest exit of the exhaust from the engine because, in most cases, the exhaust gas temperatures of these engines are very high. Thus, a hole is formed in the hood of the trucks and the exhaust stack is slid through the hole to permit the quickest exit of the exhaust into the atmosphere. However although the hood may be non-horizontally oriented, the stack should be kept in a vertical position. Thus, a stack mounting basket is positioned beneath the hole having three widely separated outwardly extending threaded bolt extensions that are positioned within three slotted downwardly extending elongated members affixed to the hood. The relative positions of the elongated members with respect to the threaded bolt extensions are adjusted, and nuts are tightened over the elongated members to permit the stack to maintain a vertical orientation.

12 Claims, 3 Drawing Sheets

ENGINE HOOD EXHAUST STACK MOUNTING METHOD

BACKGROUND OF THE INVENTION

For turbo-diesel application trucks it is desirable to enable the quickest exit for the exhaust from the engine. This is because, in most cases, the exhaust gas temperatures of these engines are very high.

SUMMARY OF A PREFERRED EMBODIMENT OF THE INVENTION

In view of the foregoing, it is desirable to cut one hole in the hood of the trucks to allow the stack to slide through to permit the quickest exit of the exhaust into the atmosphere. It is also an object of the invention to maintain the stack in a vertical position regardless of the slope of the hood.

In accordance with the invention, a circular hole is formed within the engine hood which may be non-horizontally oriented, a cylindrical stack mounting basket is positioned beneath the hole for receiving an exhaust stack therein, the stack mounting basket having three widely separated outwardly extending threaded bolt extensions positioned about the outside circumference of the mounting basket. A circular hood plate is positioned over the hood and about the hole, the circular hood plate having three downwardly extending elongated members, each elongated member having an elongated slot therein for receiving one of said threaded bolt extensions.

The upper hood plate, a high temperature sealing gasket and a lower mounting ring under the sealing gasket and under the hood are all bolted together about the hole, wherein the lower mounting ring secures the upper hood plate to the hood. Next, the relative positions of the elongated members of the hood plate with respect to the threaded bolt extensions of the mounting basket are adjusted for permitting the stack to maintain a vertical orientation through the hole regardless of non-horizontal variations of the hood; and a threaded nut is tightened over each of the three widely separated outwardly extending threaded bolt extensions of the stack mounting basket, thereby to maintain the vertically oriented position of the stack.

BRIEF DESCRIPTION OF THE DRAWINGS

Other aspects of the invention will become more apparent upon study of the following description taken in conjunction with the drawings in which.

DETAILED DESCRIPTION OF PREFERRED EMBODIMENTS OF THE INVENTION

Figure 1:
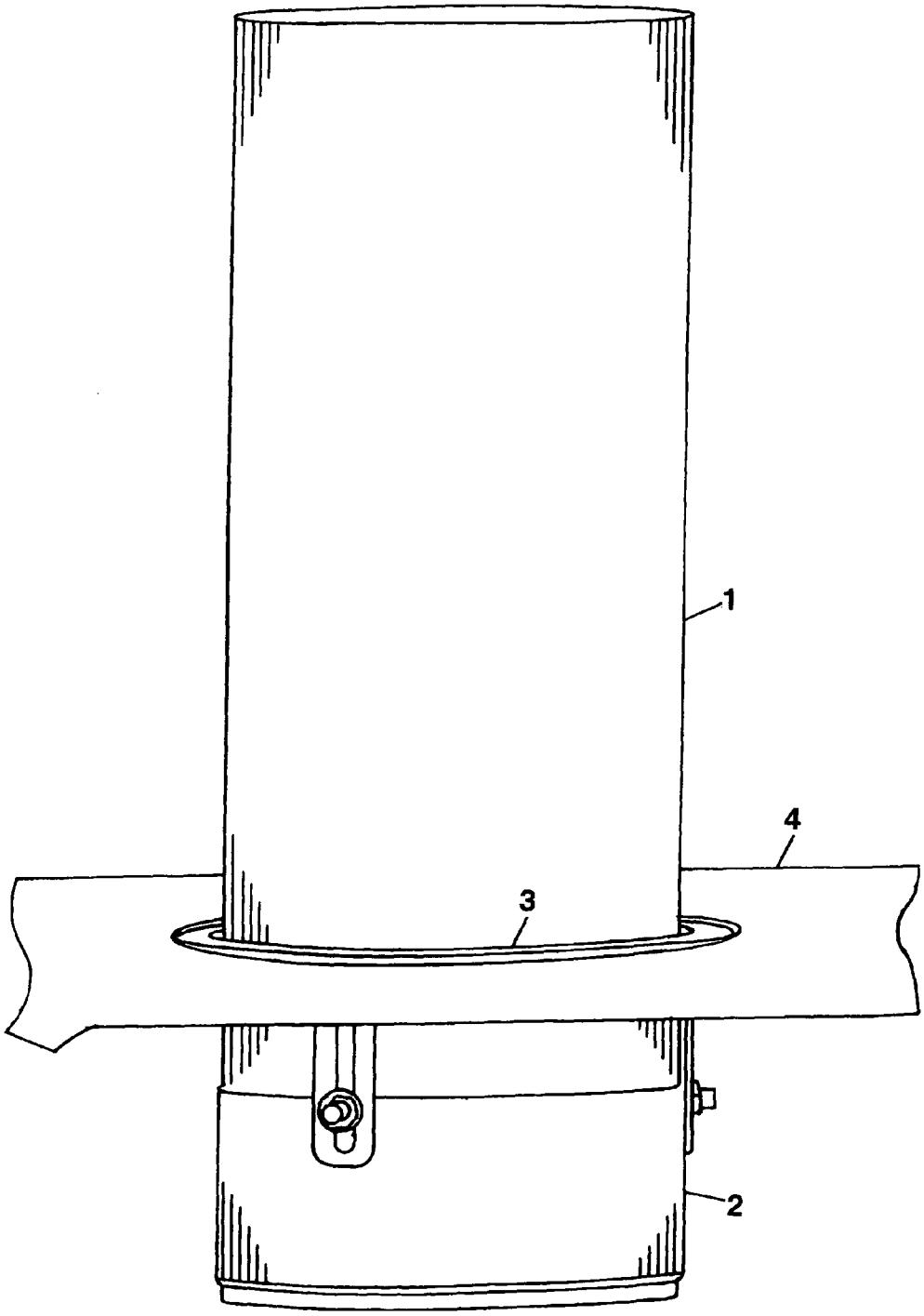
FIG. 1 is a view of the stack positioned within a non-slanted hood that is horizontally oriented.

In FIG. 1, an engine exhaust stack 1 is passed through a circular hole 3 within a hood 4 over an engine, and is received within stack mounting basket 2 positioned over the engine. The hood can be a truck hood over the engine driving the truck or could be a hood over another vehicle or even a stationary engine having a stack passed through the hood.

Figure 2:
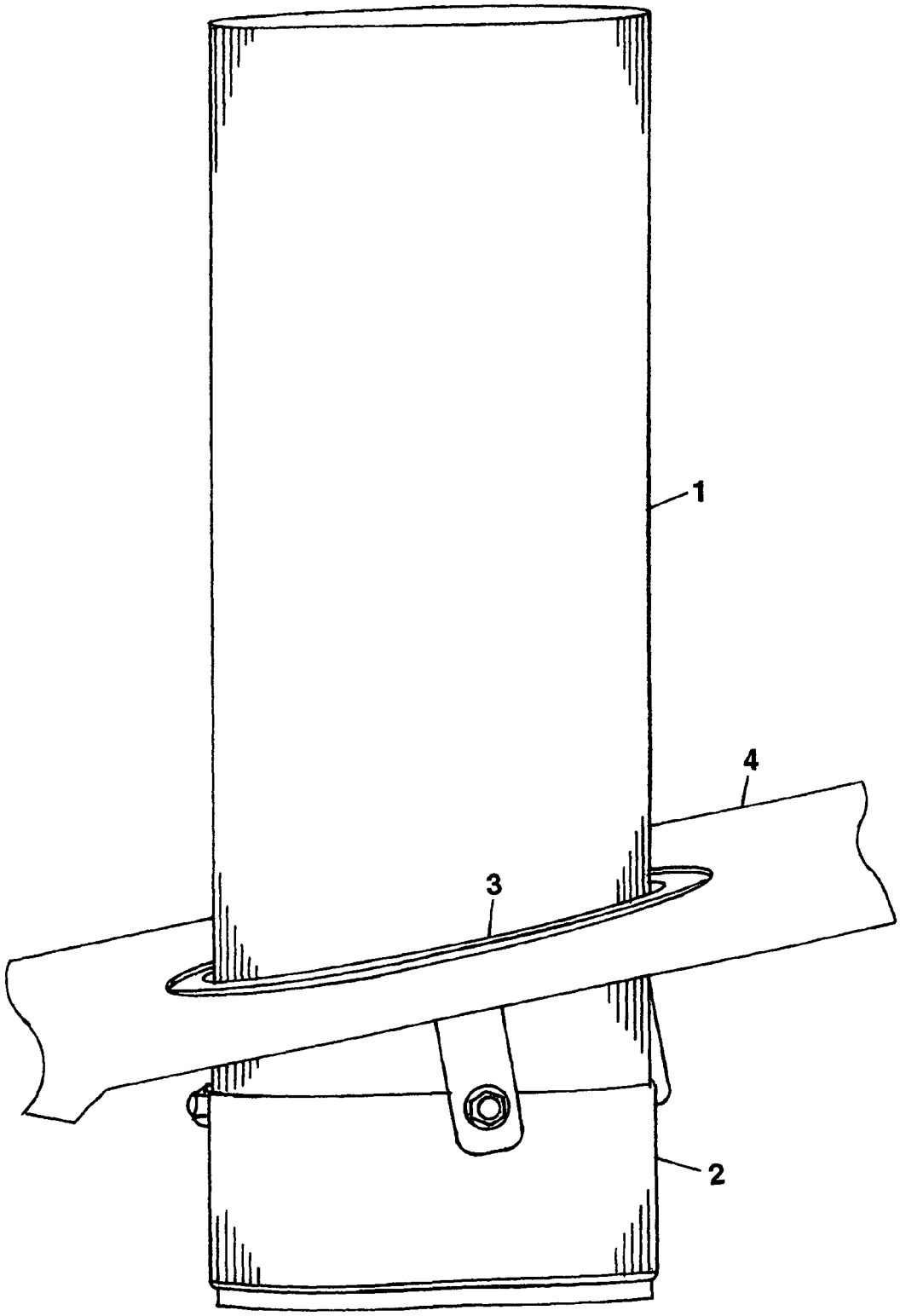
FIG. 2 shows how the stack is maintained in a vertical position where the engine hood is slanted in a non-horizontal position in space.
Figure 3:
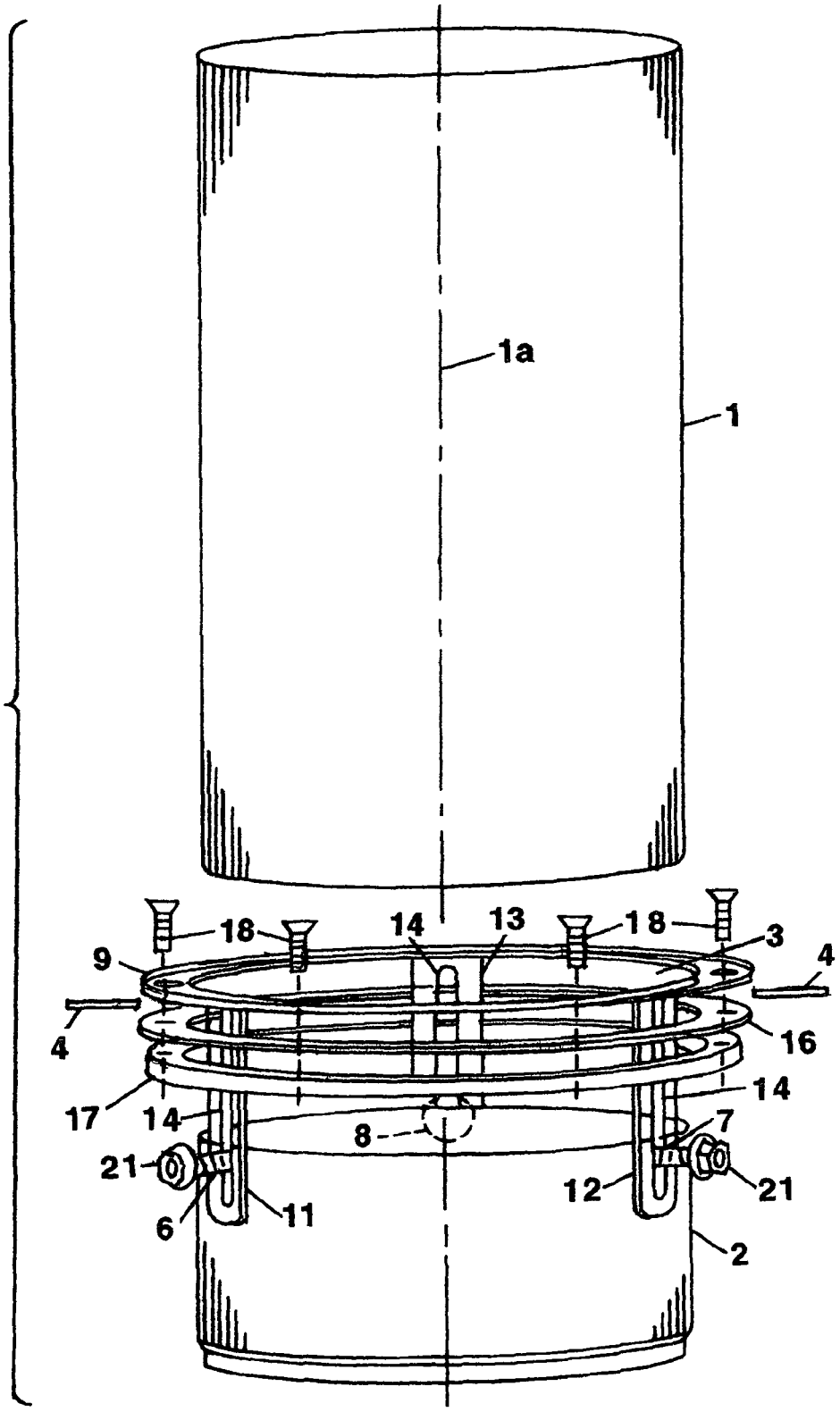
FIG. 3 is an exploded view of the components provided by the kit of the invention and how they are positioned with respect to each other.

FIG. 2 shows a vertical stack orientation with respect to a slanted, non-horizontal hood tilted in orthogonal directions with respect to axis 1*a* (FIG. 3). The following description will explain how this is accomplished.

FIG. 3 is an exploded view showing the positioning of the various components of the kit supplied to the user for carrying out the method of the invention that includes stack mounting basket 2 for receiving stack 1; upper hood plate 9, high temperature sealing gasket 16, lower mounting ring 17, and screws 18. The hood plate 9 has downwardly extending elongated members 11, 12 and 13 that have the same configurations, each having elongated slots 14, therein along with nuts 21, for slidably receiving threaded bolt extension members 6, 7 and 8 affixed to and extending outwardly from the stack mounting basket 2.

The preferred method of the invention includes:

(a) having the user form a hole 3 in the hood 4 for receiving the exhaust stack therein;

(b) positioning the stack mounting basket 2 beneath the hole 3 in the hood for receiving the stack therein, the stack mounting basket having three widely separated outwardly extending threaded bolt extension members 6, 7, and 8 positioned around the outside circumference of the mounting basket;

(c) positioning a hood plate 9 over the hood and about the hole, the hood plate having three downwardly extending elongated members 11, 12 and 13, each elongated member having an elongated slot 14 therein for receiving one of the threaded bolt extension members;

(d) positioning a high temperature resistant sealing gasket 16 under the hood plate 9;

(e) positioning a lower mounting ring 17 under the sealing gasket for securing the hood plate to the hood, employing screws 18;

(f) fastening the hood plate, sealing gasket and the lower mounting ring together about the hole by fastener screws 18;

(g) adjusting the positions of the slotted elongated members 11, 12 and 13 of the hood plate 9 with respect to the outwardly extending threaded bolt extension members 6, 7 and 8 of the mounting basket 2 that are positioned within the elongated slots 14 for permitting the stack to maintain a vertical orientation through the hole regardless of non-horizontal variations of the hood as shown in FIG. 2; and (h) tightening a threaded nut 21 over each of the three widely separated outwardly extending threaded bolt extension members 6, 7 and 8 of the stack mounting basket 2, thereby to maintain the vertically oriented position of the stack.

The method is particularly applicable to stack mounting upon the hood of a turbo-diesel application truck.

What is claimed is:

1. A method of mounting a vertically oriented exhaust stack through a hood over an engine regardless of a non-horizontal hood's orientation comprising:

(a) forming a hole in said hood for receiving said exhaust stack therein;

(b) providing a basket member positioned beneath the hood for receiving the stack, the basket member having three or more widely separated outwardly extending extension members positioned around the basket member;

(c) affixing a hood plate to the hood and about the hole, the hood plate having three or more downwardly extending elongated members, each elongated member having at least one orifice therein for receiving one of said extension members;

(d) positioning a sealing gasket under said hood plate;

(e) positioning a mounting member beneath the sealing gasket for securing the hood plate to the hood;

(f) fastening the hood plate, sealing gasket and mounting member together about the hole;

(g) adjusting the positions of the elongated members of the hood plate with respect to the extension members of the basket member for permitting the stack to maintain a vertical orientation through the hole regardless of non-horizontal variations of said hood; and (h) thereafter affixing the current positions of the elongated members of the hood plate with respect to the extension members of the basket member, thereby to maintain the vertically oriented position of the stack.

2. The method of claim 1 including affixing a high temperature resistant gasket to the hood about the hole.

3. The method of claim 1 including mounting said stack upon the hood of a turbo-diesel application truck.

4. The method of claim 2 including mounting said stack upon the hood of a turbo-diesel application truck.

5. A method of mounting a vertically oriented engine exhaust stack through a hood over an engine regardless of a non-horizontal hood's orientation comprising:

(a) forming a hole in said hood for receiving said exhaust stack therein;

(b) providing a stack mounting basket positioned beneath the hole for receiving the stack therein, the stack mounting basket having three or more widely separated outwardly extending threaded bolt extension members positioned around the outside circumference of the mounting basket;

(c) positioning a hood plate over the hood and about the hole, the hood plate having three or more downwardly extending elongated members, each elongated member having an elongated slot therein for receiving one of said threaded bolt extension members;

(d) positioning a sealing gasket under said hood plate;

(e) positioning a lower mounting ring under the sealing gasket for securing the hood plate to the hood;

(f) fastening the hood plate, sealing gasket and the lower mounting ring together about the hole;

(g) adjusting the positions of the elongated members of the hood plate with respect to the threaded bolt extension members of the mounting basket positioned within the elongated slots for permitting the hole to maintain a vertical orientation through the hole regardless of non-horizontal variations of said hood; and (h) tightening a threaded nut over each of the three or more widely separated outwardly extending threaded bolt extension members of the stack mounting basket, thereby to maintain the vertically oriented position of the stack.

6. The method of claim 5 including affixing a high temperature resistant gasket to the hood about the hole.

7. The method of claim 5 including mounting said stack upon the hood of a turbo-diesel application truck.

8. The method of claim 6 including mounting said stack upon the hood of a turbo-diesel application truck.

9. A method of mounting a vertically oriented exhaust stack through a hood over an engine regardless of a non-horizontal hood's orientation comprising:

(a) forming a hole in said hood for receiving said exhaust stack therein;

(b) providing a basket member positioned beneath the hood for receiving the stack, the basket member having three or more widely separated outwardly extending extension members positioned around the basket member;

(c) affixing a hood plate to the hood and about the hole, the hood plate having three or more downwardly extending elongated members, each elongated member having at least one orifice therein for receiving one of said extension members;

(d) positioning a mounting member beneath the hood plate for securing the hood plate to the hood;

(e) fastening the hood plate, and mounting member together about the hole;

(f) adjusting the positions of the elongated members of the hood plate with respect to the extension members of the basket member for permitting the stack to maintain a vertical orientation through the hole regardless of non-horizontal variations of said hood; and (g) thereafter affixing the current positions of the elongated members of the hood plate with respect to the extension members of the basket member, thereby to maintain the vertically oriented position of the stack.

10. The method of claim 9 including affixing a high temperature resistant gasket to the hood about the hole.

11. The method of claim 9 including mounting said stack upon the hood of a turbo-diesel application truck.

12. The method of claim 10 including mounting said stack upon the hood of a turbo-diesel application truck.

* * * * *